US011501588B2

(12) United States Patent
Novozhenets et al.

(10) Patent No.: US 11,501,588 B2
(45) Date of Patent: Nov. 15, 2022

(54) ON DEMAND ACCESS CONTROL AUTHORIZATION USING MOBILE DEVICES

(71) Applicant: CARRIER CORPORATION, Palm Beach Gardens, FL (US)

(72) Inventors: Yuri Novozhenets, Pittsford, NY (US); Jason Higley, Pittsford, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 242 days.

(21) Appl. No.: 16/609,465

(22) PCT Filed: May 2, 2018

(86) PCT No.: PCT/US2018/030552
§ 371 (c)(1),
(2) Date: Oct. 30, 2019

(87) PCT Pub. No.: WO2018/204430
PCT Pub. Date: Nov. 8, 2018

(65) Prior Publication Data

US 2020/0193753 A1 Jun. 18, 2020

Related U.S. Application Data

(60) Provisional application No. 62/500,580, filed on May 3, 2017.

(51) Int. Cl.
*G07C 9/22* (2020.01)
*G07C 9/00* (2020.01)
*G07C 9/27* (2020.01)

(52) U.S. Cl.
CPC ..... *G07C 9/22* (2020.01); *G07C 9/00904* (2013.01); *G07C 9/27* (2020.01)

(58) Field of Classification Search
CPC ..... G07C 9/22; G07C 9/27; G07C 9/00904
See application file for complete search history.

(56) References Cited

U.S. PATENT DOCUMENTS 9,767,630 B1 * 9/2017 Kazerani ..... G07C 9/28
2002/0059436 A1 * 5/2002 Kubo ..... H04L 69/40 709/229

(Continued)

FOREIGN PATENT DOCUMENTS

CN 104631961 A 5/2015
CN 105303656 A 2/2016

(Continued)

OTHER PUBLICATIONS

PCT Notification of Transmittal of the International Search Report of International Application No. PCT/US2018/030552; dated Aug. 10, 2018; Report Received Date: Aug. 17, 2018; 6 pages.

(Continued)

*Primary Examiner* — Carlos Garcia
(74) *Attorney, Agent, or Firm* — Cantor Colburn LLP

(57) ABSTRACT

A method of controlling access to at least one access point is provided. The method comprising: transmitting, using a requesting device, an access request to an access device; generating, using the access device, an authorization information request in response to the access request; generating an authorization request in response to the authorization information request; transmitting, using the requesting device, the authorization request to an authorization service; generating, using the authorization service, an authorization token in response to the authorization request; transmitting, using the authorization service, the authorization token to the requesting device; transmitting, using the requesting device, the authorization token to the access device; vali- (Continued)

Figure 1:
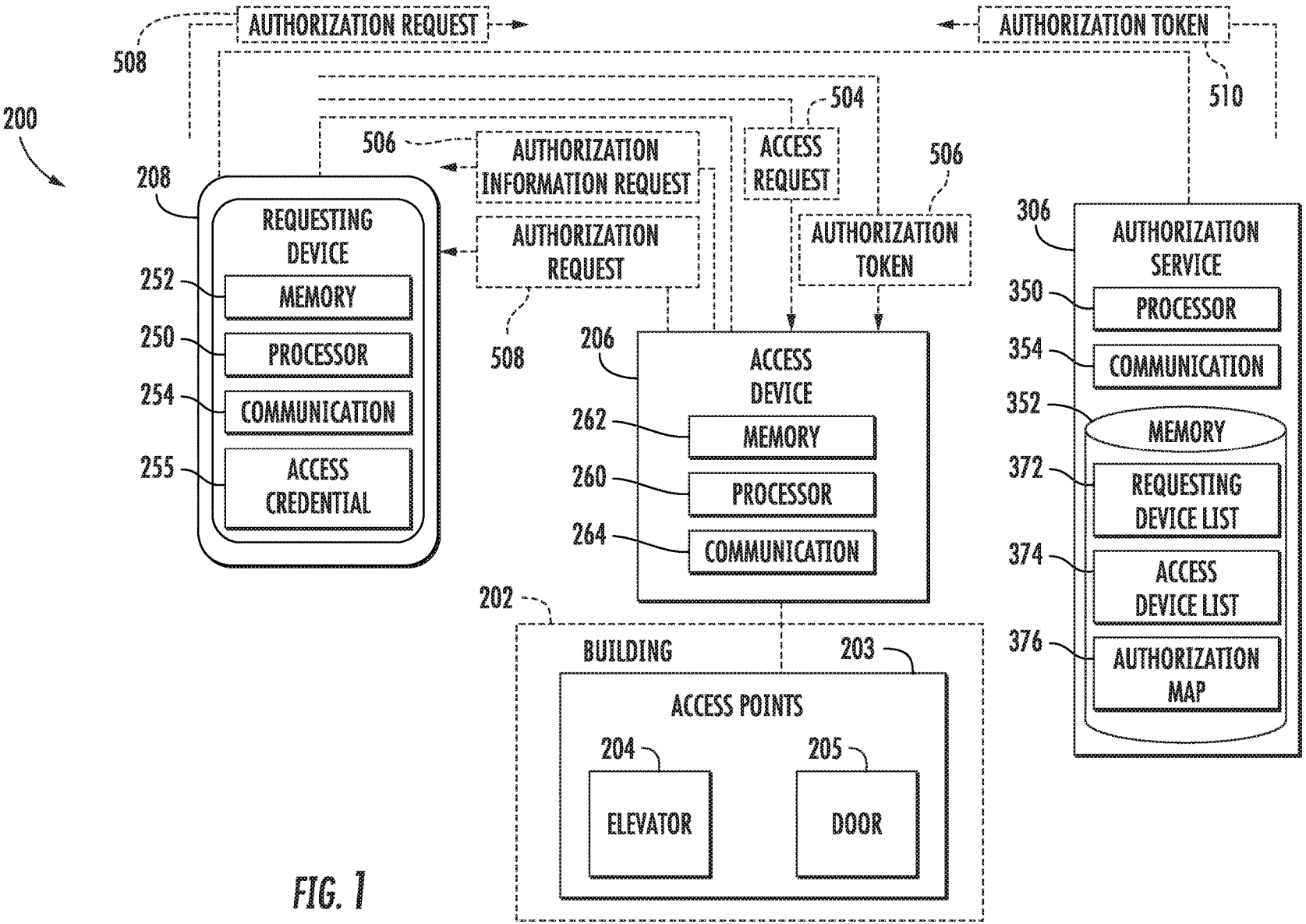

dating, using the access device, the authorization token; and adjusting, using the access device, at least one access point.

20 Claims, 2 Drawing Sheets

(56) References Cited

U.S. PATENT DOCUMENTS

2003/0134615 A1* 7/2003 Takeuchi ..... G06Q 20/341 455/406
2006/0170533 A1 8/2006 Chioiu et al.
2010/0093342 A1* 4/2010 Ramachandra Rao ..... H04W 12/06 455/432.1
2011/0295715 A1* 12/2011 Wakabayashi ..... G06Q 20/12 705/26.43
2014/0049364 A1* 2/2014 Ahearn ..... G07C 9/00174 340/5.51
2014/0344161 A1* 11/2014 Sato ..... G06Q 20/105 705/67
2016/0019536 A1* 1/2016 Ortiz ..... G06Q 20/3227 705/67
2020/0036525 A1* 1/2020 Han ..... G07C 9/27
2020/0092925 A1* 3/2020 Foster ..... G06F 3/011
2022/0004613 A1* 1/2022 Dange ..... H04L 63/0861

FOREIGN PATENT DOCUMENTS

CN 105488887 A 4/2016
EP 2672464 A1 12/2013
WO 2006082526 A1 8/2006
WO 2006136662 A1 12/2006

OTHER PUBLICATIONS

Written Opinion of the International Searching Authority of International Application No. PCT/US2018/030552; dated Aug. 10, 2018; Report Received Date: Aug. 17, 2018; 12 pages.

* cited by examiner

ON DEMAND ACCESS CONTROL AUTHORIZATION USING MOBILE DEVICES

CROSS-REFERENCE TO RELATED APPLICATIONS

This application is a National Stage of International Application No. PCT/US2018/030552 filed May 2, 2018, which claims priority to U.S. Provisional Patent Application Ser. No. 62/500,580 filed May 3, 2017, both of which are incorporated herein by reference in their entirety.

BACKGROUND

The subject matter disclosed herein generally relates to the field of physical access control, and more particularly to an apparatus and method for controlling access to access points.

Existing online access control to access points are commonly set up such that access devices are directly connected to an authorization provider (such as an access control panel). In an example, the access device would be a card reader and the access point may be a secured door. The requesting device sends the access request to access device. The access device communicates directly to the authorization provider to request access to the access point.

In the event the access device is not directly connected to an authorization provided, existing offline access control to access points require the access devices to be the authorization provider (such as an offline access reader). In an example, the access device may be a card reader and the access point may be a secured door. The access device processes the access request and makes an authorization decision for the access point. Offline access devices are unable to receive updates, thus creating challenges when authorization changes are required.

BRIEF SUMMARY

According to one embodiment, a method of controlling access to at least one access point is provided. The method comprising: transmitting, using a requesting device, an access request to an access device; generating, using the access device, an authorization information request in response to the access request; generating an authorization request in response to the authorization information request; transmitting, using the requesting device, the authorization request to an authorization service; generating, using the authorization service, an authorization token in response to the authorization request; transmitting, using the authorization service, the authorization token to the requesting device; transmitting, using the requesting device, the authorization token to the access device; validating, using the access device, the authorization token; and adjusting, using the access device, at least one access point.

In addition to one or more of the features described above, or as an alternative, further embodiments of the method may include where the authorization request is generated by the access device and transmitted to the requesting device.

In addition to one or more of the features described above, or as an alternative, further embodiments of the method may include where the authorization information is transmitted to the requesting device and the requesting device generates the authorization request.

In addition to one or more of the features described above, or as an alternative, further embodiments of the method may include where the authorization token is configured to be used one time.

In addition to one or more of the features described above, or as an alternative, further embodiments of the method may include where the authorization token is configured to be used for a selected time period.

In addition to one or more of the features described above, or as an alternative, further embodiments of the method may include where the authorization token is configured to be used for a selected number of times.

In addition to one or more of the features described above, or as an alternative, further embodiments of the method may include where the adjusting further comprises: unlocking a door lock.

In addition to one or more of the features described above, or as an alternative, further embodiments of the method may include where the adjusting further comprises: opening an elevator door.

In addition to one or more of the features described above, or as an alternative, further embodiments of the method may include where the requesting device transmits an access request to an access device when the requesting device is located within a selected range of the access device.

According to another embodiment, an access control system is provided. The access control system comprising: an access device; an authorization service; and a requesting device in communication with the access device and the authorization service. The requesting device comprising: a processor; a memory comprising computer-executable instructions that, when executed by the processor, cause the processor to perform operations, the operations comprising: transmitting an access request to the access device; receiving an authorization information request generated by the access device in response to the access request; transmitting an authorization request to the authorization service; receiving an authorization token generated by the authorization service in response to the authorization request; and transmitting the authorization token to the access device; wherein the access device validates the authorization token and adjusts at least one access point.

In addition to one or more of the features described above, or as an alternative, further embodiments of the access control system may include where the authorization request is generated by the access device and transmitted to the requesting device.

In addition to one or more of the features described above, or as an alternative, further embodiments of the access control system may include where the authorization request information is transmitted to the requesting device and the requesting device generates the authorization request.

In addition to one or more of the features described above, or as an alternative, further embodiments of the access control system may include where the authorization token is configured to be used one time.

In addition to one or more of the features described above, or as an alternative, further embodiments of the access control system may include where the authorization token is configured to be used for a selected time period.

In addition to one or more of the features described above, or as an alternative, further embodiments of the access control system may include where the authorization token is configured to be used for a selected number of times.

In addition to one or more of the features described above, or as an alternative, further embodiments of the access control system may include where the at least one access point includes a door lock.

In addition to one or more of the features described above, or as an alternative, further embodiments of the access control system may include where the at least one access point includes an elevator door.

In addition to one or more of the features described above, or as an alternative, further embodiments of the access control system may include where the requesting device transmits an access request to an access device when the requesting device is located within a selected range of the access device.

According to another embodiment, a computer program product tangibly embodied on a computer readable medium is provided. The computer program product including instructions that, when executed by a processor, cause the processor to perform operations comprising: transmitting an access request to an access device; receiving an authorization information request generated by the access device in response to the access request; transmitting an authorization request to an authorization service; receiving an authorization token generated by the authorization service in response to the authorization request; and transmitting the authorization token to the access device; wherein the access device validates the authorization token and adjusts at least one access point.

Technical effects of embodiments of the present disclosure include an access device utilizing a requesting device to communicate with an authorization service and adjust an access point.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION

Figure 2:
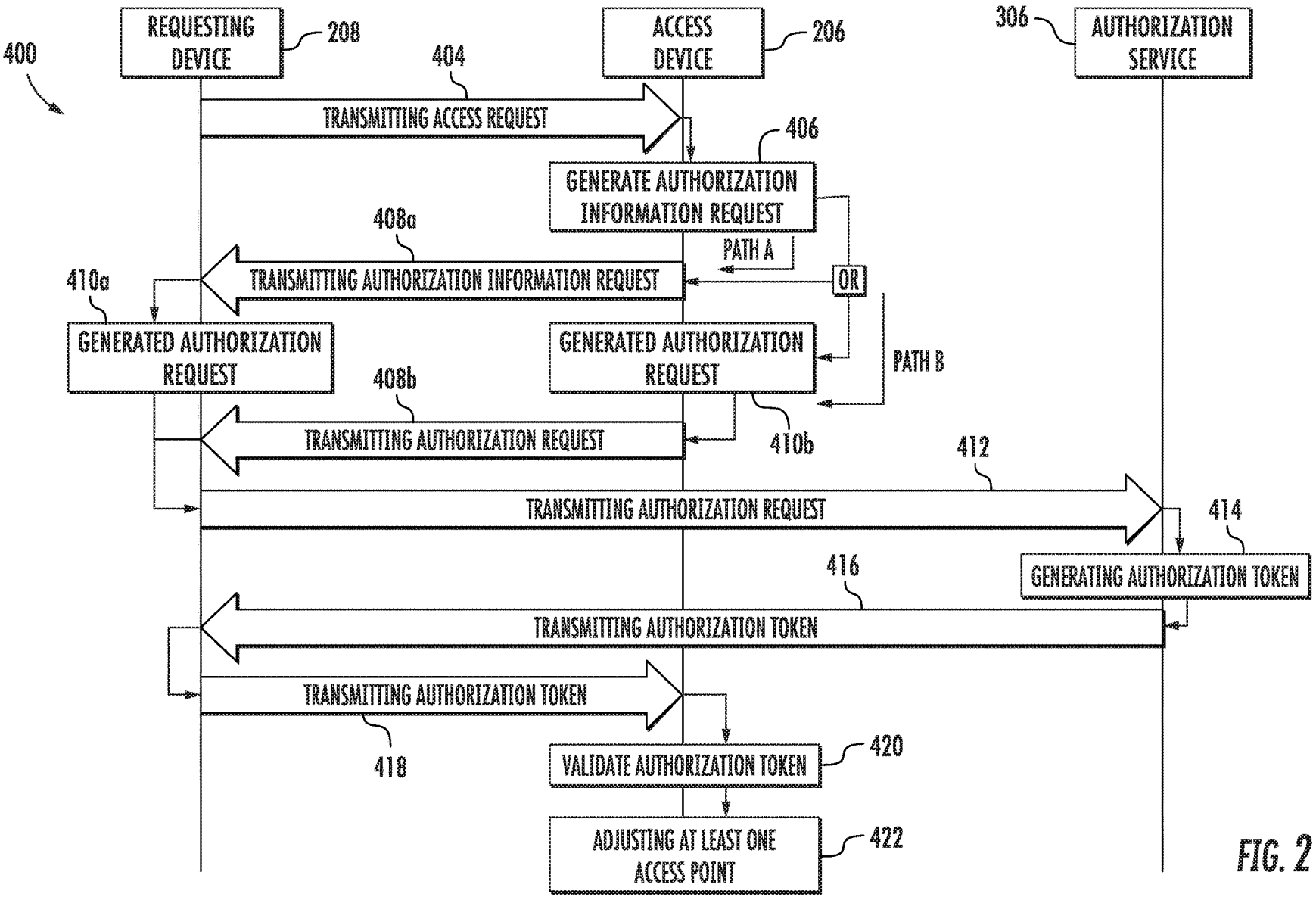

The following descriptions should not be considered limiting in any way. With reference to the accompanying drawings, like elements are numbered alike:

FIG. 1 illustrates a schematic view of an access control system, in accordance with an embodiment of the disclosure; and FIG. 2 is a flow diagram illustrating a method of controlling access to at least one access point, according to an embodiment of the present disclosure.

DETAILED DESCRIPTION

A detailed description of one or more embodiments of the disclosed apparatus and method are presented herein by way of exemplification and not limitation with reference to the Figures.

FIG. 1 depicts an access control system 200 in an example embodiment. The access control system 200 includes at least one access device 206 to grant/deny access to access points 203, such as for example an elevator 204 or a door 205. The access device 206 grant/deny access to access points 203 by adjusting the access point 203, such as, for example, unlocking a door lock or opening an elevator door. The door 205 and an elevator 204 may be installed at a building 202. In some embodiments, the building 202 may be a building or a collection of buildings that may or may not be physically located near each other. The building 202 may include any number of floors. Persons entering the building 202 may enter at a lobby floor, or any other floor, and may go to a destination floor via one or more conveyance devices, such as the elevator 204. Persons entering the building 202 may be required to enter a door 205. In another non-limiting embodiment, the door 205 may be outside of a building, such as, for example a car door. The door 205 may include but is not limited to a door in a wall of the building 202, a door on the outside of the building 202, a garage door, a parking lot access gate, a turnstile, a car door, or similar access point known to one of skill in the art.

The access points 203 may be operably connected to one or more access devices 206. The access device 206 may be configured to control access to the access points 203, such as, for example an elevator 204 and a door 205. Although only one elevator 204 is shown in FIG. 1, it is understood that any number of elevators cars 204 may be used in the access control system 200. It is understood that other components of the elevator 204 (e.g., elevator car, doors, drive, counterweight, safeties, etc.) are not depicted for ease of illustration. It is also understood that each elevator 204 may utilize one or more access devices 206. In an example, there may be an access device located on each floor of the building 202 located proximate an elevator shaft. Further, although only one door 205 is shown in FIG. 1, it is understood that any number of doors 205 may be used in the access control system 200. It is understood that other components of doors 205 are not depicted for ease of illustration (e.g., locks). It is also understood that each door 205 may utilize one or more access devices 206.

In a non-limiting example, the access device 206 may be a door reader or door strike. The access device 206 may include a processor 260, memory 262 and communication module 264 as shown in FIG. 1. The processor 260 can be any type or combination of computer processors, such as a microprocessor, microcontroller, digital signal processor, application specific integrated circuit, programmable logic device, and/or field programmable gate array. The processor 260 may generate a non-repeating and random ID for each access request 504 by a requesting device 208. The memory 262 is an example of a non-transitory computer readable storage medium tangibly embodied in the access device 206 including executable instructions stored therein, for instance, as firmware. The memory 262 may store a unique device ID for each access device 206. The memory 262 may also store a set of geo-location information for each access device 206. The communication module 264 allows for secure bi-directional communication wirelessly with a requesting device 208. The communication module 264 may implement one or more communication protocols as described in further detail herein. The access device 206 may be configured to transmit an authorization information request 506 to a requesting device 208 in response to an access request 504 received from the requesting device 208, as described further below in method 400 of FIG. 2. The authorization information request 506 may include information such as, for example, an ID of the access device 206, time of the access request 504, location of the access device 206, a non-repeating ID, and an authorization service endpoint.

Also shown in FIG. 1 is a requesting device 208. The requesting device 208 is capable of secure bi-directional communication with the access device 206 and an authorization service. The requesting device 208 is configured to transmit an access request 504 and an authorization token 510 to the access device 206, as described further below in method 400 of FIG. 2. The requesting device 208 is also configured to transmit an authorization request 508 to an authorization service 510, as described further below in method 400 of FIG. 2. The requesting device 208 is configured to store a unique credential 255 that may be shared with the access device 206. The requesting device 208 may be a mobile computing device that is typically carried by a person, such as, for example a phone, PDA, smart watch, tablet, laptop, etc. The requesting device 208 may include a processor 250, memory 252 and communication module 254 as shown in FIG. 1. The processor 250 can be any type or combination of computer processors, such as a microprocessor, microcontroller, digital signal processor, application specific integrated circuit, programmable logic device, and/or field programmable gate array. The memory 252 is an example of a non-transitory computer readable storage medium tangibly embodied in the requesting device 208 including executable instructions stored therein, for instance, as firmware. The communication module 254 may implement one or more communication protocols as described in further detail herein. In a non-limiting example, the requesting device 208 may belong to an employee and/or resident of the building 202.

Also shown in FIG. 1 is an authorization service 306. The authorization service 306 is configured to receive authorization requests 508 and process the request. Processing the request may include validating the client, validating the requesting device 208, validating the authorization of the requesting device 208, creating an authorization token 510 and transmitting the authorization token 510 to the requesting device 208. The authorization service may include a processor 350, memory 352 and communication module 354 as shown in FIG. 1. The processor 350 can be any type or combination of computer processors, such as a microprocessor, microcontroller, digital signal processor, application specific integrated circuit, programmable logic device, and/or field programmable gate array. The memory 352 is an example of a non-transitory computer readable storage medium tangibly embodied in or operably connected to the authorization service including executable instructions stored therein, for instance, as firmware. The memory 352 may include a requesting device list 372, an access device list 374, and an authorization map 376. The authorization map 376 maps access credential 255 stored on the requesting devices 208 to access device 206 that each access credential 255 has access to. The communication module 354 may implement one or more communication protocols as described in further detail herein.

The requesting device 208 and the access device 206 communicate with one another. For example, the requesting device 208 and the access device 206 may communicate with one another when proximate to one another (e.g., within a threshold distance). For example, the networked element may communicate with the requesting device 208 using near field communications (NFC). In other embodiments, the location of the requesting device 208 relative to the access device 206 may be established communication various technologies including GPS, triangulation, or signal strength detection, by way of non-limiting example. In example embodiments, the requesting device 208 communicates with the access device 206 over multiple independent wired and/or wireless networks. Embodiments are intended to cover a wide variety of types of communication between the requesting device 208 and access device 206, and embodiments are not limited to the examples provided in this disclosure. For example, the requesting device 208 and the access device 206 may communicate over a wireless network, such as 802.11x (WiFi), short-range radio (Bluetooth), cellular, satellite, etc.

The requesting device 208 and the authorization service 306 communicate with one another. The requesting device 208 and the authorization service 306 may communicate over a wireless network, such as 802.11x (WiFi), short-range radio (Bluetooth), cellular, satellite, etc. In some embodiments, the authorization service 306 may include, or be associated with (e.g., communicatively coupled to) a networked element, such as kiosk, beacon, lantern, bridge, router, network node, building intercom system, etc. The networked element may communicate with the requesting device 208 using one or more communication protocols or standards. For example, the networked element may communicate with the requesting device 208 using near field communications (NFC). In other embodiments, the requesting device may establish communication with an authorization service 306 that is not associated with a networked element in the building 202. This connection may be established with various technologies including GPS, 802.11x (WiFi), cellular, or satellite, by way of non-limiting example. In example embodiments, the requesting device 208 communicates with the authorization service 306 over multiple independent wired and/or wireless networks. Embodiments are intended to cover a wide variety of types of communication between the requesting device 208 and the authorization service 306 and embodiments are not limited to the examples provided in this disclosure.

The access device 206 does not communicate directly with the authorization service 306. Advantageously, eliminating the need for the access device 206 to communicate directly with the authorization service 306 allows for more flexibility in determining a location for placement of the access device 206. Also advantageously, allowing the access device 206 to communicate to the authorization service 306 through the requesting device 208 eliminates a great deal of wiring that typically would have been previously required to connect the access device 206 to the authorization service 306.

Referring now to FIG. 2, while referencing components of FIG. 1. FIG. 2 shows a flow chart of method 400 of controlling access to access points 203, in accordance with an embodiment of the disclosure. At block 404, a requesting device 208 transmits an access request 504 to an access device 206. In an embodiment, the requesting device 208 may transmit the access request 504 to the access device 206 when the requesting device 208 is located within a selected range of the access device 206. At block 406, the access device 206 generates an authorization information request 506 in response to the access request 504.

Following block 406, there are two possible paths to take to block 412 depending on whether the requesting device 208 or the access device 206 will generate an authorization request 508 in response to the authorization information request 506 (e.g. Path A and Path B, see FIG. 2). If the access device 206 generates the authorization request 508 then block 406 will lead to block **410*b* via path B as shown in FIG. 2. At block 410*b*, the access device 206 generates the authorization request 508 in response to the authorization information request 506. Once the authorization request 508 is generated by the access device 206 then the authorization request 508 is transmitted to the requesting device 208. Alternatively, if the requesting device 208 will generate the authorization request 508 then block 406 will lead to block 408*a* and the authorization information request 506 will be transmitted to the requesting device 208***a* via path A, as shown in FIG. 2. At block 410*a*, the requesting device 208*a* generates the authorization request 508 in response to the authorization information request 506.

At block 412, the requesting device 208 transmits the authorization request 508 to an authorization service 306. At block 414, the authorization service 306 generates an authorization token 510 in response to the authorization request 508. In an embodiment, the authorization token 510 is configured to be used one time, such as, for example a one-time use authorization token 510. In another embodiment, the authorization token 510 is configured to be used for a selected time period. In a non-limiting example, the selected time period may be twenty-four hours. In another embodiment, the authorization token 510 is configured to be used for a selected number of times. In a non-limiting example, the selected number of time may be four times.

At block 416, the authorization service 306 transmits the authorization token 510 to the requesting device 208. At block 418, the requesting device 208 transmits the authorization token 510 to the access device. At block 420, the access device 206 validates the authorization token 510. At block 422, the access device 206 adjusts at least one access point. The adjustment will not occur unless the authorization token is valid. As mentioned above, the access point may be a door 205 or an elevator 204. In one example, the access device 206 may unlock a door 205 when the authorization token 510 is validated. In another example, the access device 206 may open an elevator door when the authorization token 510 is validated.

While the above description has described the flow process of FIG. 2 in a particular order, it should be appreciated that unless otherwise specifically required in the attached claims that the ordering of the steps may be varied.

As described above, embodiments can be in the form of processor-implemented processes and devices for practicing those processes, such as a processor. Embodiments can also be in the form of computer program code containing instructions embodied in tangible media, such as network cloud storage, SD cards, flash drives, floppy diskettes, CD ROMs, hard drives, or any other computer-readable storage medium, wherein, when the computer program code is loaded into and executed by a computer, the computer becomes a device for practicing the embodiments. Embodiments can also be in the form of computer program code, for example, whether stored in a storage medium, loaded into and/or executed by a computer, or transmitted over some transmission medium, loaded into and/or executed by a computer, or transmitted over some transmission medium, such as over electrical wiring or cabling, through fiber optics, or via electromagnetic radiation, wherein, when the computer program code is loaded into an executed by a computer, the computer becomes an device for practicing the embodiments. When implemented on a general-purpose microprocessor, the computer program code segments configure the microprocessor to create specific logic circuits.

The term "about" is intended to include the degree of error associated with measurement of the particular quantity based upon the equipment available at the time of filing the application. For example, "about" can include a range of ±8% or 5%, or 2% of a given value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A method of controlling access to at least one access point, the method comprising:

transmitting, using a requesting device, an access request to an access device;

generating, using the access device, an authorization information request in response to the access request, wherein the authorization information request includes at least a non-repeating ID;

generating an authorization request in response to the authorization information request;

transmitting, using the requesting device, the authorization request to an authorization service;

generating, using the authorization service, an authorization token in response to the authorization request;

transmitting, using the authorization service, the authorization token to the requesting device;

transmitting, using the requesting device, the authorization token to the access device;

validating, using the access device, the authorization token; and adjusting, using the access device, at least one access point.

2. The method of claim 1, wherein the authorization request is generated by the access device and transmitted to the requesting device.

3. The method of claim 1, wherein the authorization information is transmitted to the requesting device and the requesting device generates the authorization request.

4. The method of claim 1, wherein the authorization token is configured to be used one time.

5. The method of claim 1, wherein the authorization token is configured to be used for a selected time period.

6. The method of claim 1, wherein the authorization token is configured to be used for a selected number of times.

7. The method of claim 1, wherein the adjusting further comprises:

unlocking a door lock.

8. The method of claim 1, wherein the adjusting further comprises:

opening an elevator door.

9. The method of claim 1, wherein the requesting device transmits an access request to an access device when the requesting device is located within a selected range of the access device.

10. The method of claim 1, wherein the authorization information request further includes an ID of the access device and at least one of a time of the access request, a location of the access request, or an authorization service endpoint.

11. An access control system comprising:

an access device;

an authorization service; and a requesting device in communication with the access device and the authorization service, the requesting device comprising:

a processor;

a memory comprising computer-executable instructions that, when executed by the processor, cause the processor to perform operations, the operations comprising:

transmitting an access request to the access device;

receiving an authorization information request generated by the access device in response to the access request, wherein the authorization information request includes at least a non-repeating ID;

transmitting an authorization request to the authorization service;

receiving an authorization token generated by the authorization service in response to the authorization request; and transmitting the authorization token to the access device;

wherein the access device validates the authorization token and adjusts at least one access point.

12. The access control system of claim 11, wherein the authorization request is generated by the access device and transmitted to the requesting device.

13. The access control system of claim 11, wherein the authorization request information is transmitted to the requesting device and the requesting device generates the authorization request.

14. The access control system of claim 11, wherein the authorization token is configured to be used one time.

15. The access control system of claim 11, wherein the authorization token is configured to be used for a selected time period.

16. The access control system of claim 11, wherein the authorization token is configured to be used for a selected number of times.

17. The access control system of claim 11, wherein the at least one access point includes a door lock.

18. The access control system of claim 11, wherein the at least one access point includes an elevator door.

19. The access control system of claim 11, wherein the requesting device transmits an access request to an access device when the requesting device is located within a selected range of the access device.

20. A computer program product tangibly embodied on a non-transitory computer readable medium, the computer program product including instructions that, when executed by a processor, cause the processor to perform operations comprising:

transmitting an access request to an access device;

receiving an authorization information request generated by the access device in response to the access request, wherein the authorization information request includes at least a non-repeating ID;

transmitting an authorization request to an authorization service;

receiving an authorization token generated by the authorization service in response to the authorization request; and transmitting the authorization token to the access device;

wherein the access device validates the authorization token and adjusts at least one access point.

* * * * *